United States Patent [19]

Barnich et al.

[11] Patent Number: 4,470,042

[45] Date of Patent: Sep. 4, 1984

[54] SYSTEM FOR DISPLAYING GRAPHIC AND ALPHANUMERIC DATA

[75] Inventors: Richard G. Barnich, Saline; Thomas B. Braun, Ann Arbor; Lloyd R. Lawrence, Tecumseh; Peter C. Schmitt, Milford, all of Mich.

[73] Assignee: Allen-Bradley Company, Milwaukee, Wis.

[21] Appl. No.: 241,277

[22] Filed: Mar. 6, 1981

[51] Int. Cl.[3] ..... G09G 1/16

[52] U.S. Cl. ..... 340/721; 340/745; 340/723

[58] Field of Search ..... 340/731, 723, 735, 790, 340/789, 721, 745

[56] References Cited

U.S. PATENT DOCUMENTS

| | | | |
|---|---|---|---|
| 3,499,979 | 3/1970 | Fiorletta et al. | 178/6.8 |
| 3,624,632 | 11/1971 | Ophir | 340/324 A |
| 3,668,622 | 6/1972 | Gannett et al. | 340/27 R |
| 3,671,956 | 6/1972 | Kegelmen et al. | 340/324 A |
| 3,735,383 | 5/1973 | Naka | 340/324 A |
| 3,742,482 | 6/1973 | Albrecht et al. | 340/324 AD |
| 3,872,461 | 3/1975 | Jarosik et al. | 340/324 AD |
| 3,883,728 | 5/1975 | Schwartz et al. | 235/152 |
| 3,891,792 | 6/1975 | Kimura | 178/5.8 R |
| 3,903,517 | 7/1975 | Hafner | 340/731 |
| 3,906,480 | 9/1975 | Schwartz et al. | 340/324 AD |
| 4,070,710 | 1/1978 | Sukonick et al. | 364/900 |
| 4,090,188 | 5/1978 | Suga | 340/731 |
| 4,121,228 | 10/1978 | Cowe et al. | 340/735 |
| 4,122,533 | 10/1978 | Kubinak | 340/790 |
| 4,124,843 | 11/1978 | Bramson et al. | 340/735 |
| 4,149,148 | 4/1979 | Miller et al. | 340/721 |
| 4,163,229 | 7/1979 | Bodin et al. | 340/745 |
| 4,197,590 | 4/1980 | Sukonick et al. | 364/900 |
| 4,200,869 | 4/1980 | Murayama et al. | 340/723 |
| 4,295,135 | 10/1981 | Sukonick | 340/721 |
| 4,404,552 | 9/1983 | Hirahata et al. | 340/721 |

*Primary Examiner*—Marshall M. Curtis
*Attorney, Agent, or Firm*—Barry E. Sammons

[57] ABSTRACT

A system for simultaneously displaying graphics and alphanumeric data on a raster scan display screen is particularly suited for use with a computerized and numerical control system for controlling machine tools or the like. A first memory stores a multi-bit data word which includes first and second subgroups of data bits respectively corresponding to an alphanumeric character and several modifications of the data to be displayed. The first subgroup of data bits defines a character field on the screen which consists of lines and columns of pixels, and is delivered as an address to a character generator which produces an output representing an alphanumeric character. A second memory stores graphics data in the form of multi-bit words which correspond to groups of pixels on each line of the screen. The alphanumeric and graphics data, as well as the second subgroup of modification bits, are selectively gated to a decoder which outputs signals to a video generator according to a preselected priority scheme. A timing circuit is synchronized with the control system's central processing unit in a manner which allows the processing unit to act as either of the graphics or alphanumeric memories without interrupting the display.

17 Claims, 12 Drawing Figures

INTERRUPT SYSTEM
42
SERIAL PORT
40
RAM
36
ROM
34
BATTERY BACK-UP
38
I/O
52
I/O
52
46
TBGI WDT
44
CPU
32
ROM
34
RAM
36
BATTERY BACK-UP
38
SERVO CONTROL INTRFC
48
3 CH ENCODER INPUT
3 CH ANALOG
46
I/O
48
I/O
48
I/O
48
46
SERIAL I/O
40
A/D
62
KEYBOARD INTRFC
26
CRT TMG GEN
56
GRAPHICS RAM
60
CRT
22
ALPHA RAM
58
54

218
214
GRDCO
ACSEL
GRCK
GLDR
GRE
V/C̄
VRSEL
A19
A18
A17
A16
A15
CAS
V/C
MRDC
216

SYSTEM FOR DISPLAYING GRAPHIC AND ALPHANUMERIC DATA

TECHNICAL FIELD

The present invention generally relates to data display systems, and deals more particularly with a device implemented method for simultaneously displaying graphics and alphanumeric data on a display screen.

BACKGROUND ART

One commonly used system for data display utilizes a device such as a cathode ray tube wherein a beam of electrons is intensity modulated while raster scanning the phosphor coated face of the tube. Other data display systems may employ a laser or other light source as the scanning beam and a xerographic drum or photographic film as the recording medium. Each of these display systems is capable of displaying graphics or alphanumeric type data either by generating adjacent lines of varying length or, more commonly by assembling arrays of rows and dots or pixels to form a pixel matrix.

Some types of prior art display systems are capable of simultaneously displaying graphics and alphanumeric data; typically, the graphics data comprises conventional television signals representing an image to be displayed and the alphanuneric characters are superimposed, by masking techniques, on the television image. Normally, the alphanumeric characters to be displayed are produced by a character generator which includes a memory having digitally coded words corresponding to each character which may be displayed.

Display systems of the type mentioned above have found an important use in computerized and numerical control systems for controlling machine tools and the like. The operator of the machine tool inputs and receives data to the machine control system via a keyboard and CRT type display. In this context, it is important that the operator be able to clearly read the display, even from a distance of six feet or more, and that he follows the proper sequence of instructions displayed on the screen.

Prior art display systems are less than satisfactory when used for CNC and similar applications. For example, characters are normally surrounded by graphics information thereby making the characters difficult to read even at a close distance. Moreover, the size of the characters is fixed, consequently, even if large character fields are provided to allow distant viewing, the display system may not be easily modified to provide smaller character fields (and thus additional character lines) when the display is viewed from a short distance, as during operator set-up of a CNC machine tool.

Another problem associated with prior art display systems is that of flicker or interference of the displayed image when the operator changes the characters to be displayed. This arises from the fact that the video output from the character generator section is interrupted when the central processing unit of the system is reading from, or writing into, the character generator's memory.

Known display systems which simultaneously display graphics and character type information or symbols may employ separate mamories for respectively storing graphics and alphanumeric data prior to display thereof. The outputs of these memories are "summed" in order to generate a composite video signal used to scan the display screen. The approach of summing the graphics and alphanumeric data signals, however, results in substantial nonuniformity of the displayed image. For example, identical characters may be displayed with differing intensities on various parts of the screen because of the nature of the particular graphics data superimposed on such characters; this, of course, makes viewing somewhat more difficult.

Accordingly, it is an important object of the present invention to provide a device implemented method for simultaneously displaying graphics and alphanumeric data on a display, such as a CRT screen, which eliminates each of the deficiencies inherent in prior art displays mentioned above.

DISCLOSURE OF THE INVENTION

According to the present invention, a device for producing electrical signals used to simultaneously display symbolic and graphical data on a data output display forming a part of a computer data system includes a first and second memory, each having addressable inputs coupled with a central processor for respectively storing character and graphical data therein. The first memory stores the character data in the form of a multi-bit data word having first and second subgroups of data bits respectively corresponding to a selected character and a possible modification of both the character and graphics data to be displayed. A second memory stores the graphics data in the form of multi-bit data words, wherein each bit corresponds to a pixel on the display. A character generator is responsive to the first group of data bits in each word derived from the first memory to generate corresponding coded signals representing a selected character. A processing circuit operates on the graphics data derived from the second memory as well as on the signals output from the character generator in accordance with the identity of the data bits of the second subgroup thereof of the first data word. The processing circuit includes a plurality of gates for selectively delivering processed signals to a decoder which combines the graphical and character data and produces an output control signal in accordance with a preselected order of priority depending upon the combination of signals present on the inputs thereof. A digital-to-analog converter translates the control signals to video signals employed for scanning the display screen. A timing circuit is synchronized with the central processing unit in a manner which allows interleafing of access to the graphics and character memories such that a processing unit may communicate with the memories without interrupting the video display. The second subgroup of data bits in the data word permits: (1) periodic blinking of the characters on the screen without affecting the graphics data, (2) reversing the color fields, i.e., black to white or white to black of either the graphics or character data, (3) reducing either the graphics or character data to half intensity, (4) disabling the graphics data within particular character fields so as to provide a graphics free background for the characters without loss of graphics data from memory, and (5) the selection of a second set of characters to be displayed. The system is responsive to control signals from the central processing unit to alter the width or height of the character fields so as to conveniently alter the size of the characters.

DESCRIPTION OF THE DRAWINGS

In the drawings, which form an integral part of the specification and are to be read in conjunction therewith, and in which like reference numerals are employed to designate identical components in the various views.

BEST MODE FOR CARRYING OUT THE INVENTION

Figure 1:
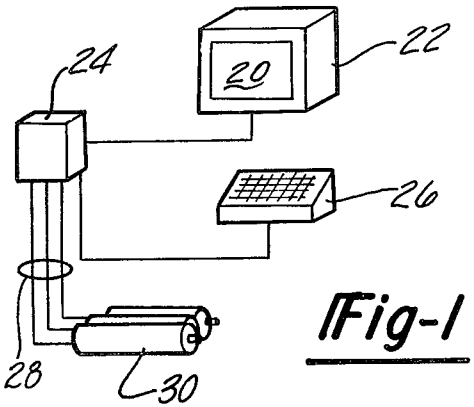
FIG. 1 is a diagrammatic view of a computerized numerical control system, employing the display of the present invention.

Referring first to FIG. 1, the present invention broadly involves a system for displaying data on the screen 20 of a data display device 22 which may comprise a CRT display (cathode ray tube). The display 22 forms a data output of a computerized control module 24 to which data may be input by a peripheral device such as keyboard 26. Control signals are output on lines 28 from modules 24 to motors 30 respectively associated with each axis of a multiaxis machine tool (not shown). Motors 30 are controlled in accordance with preprogrammed instructions stored in a later discussed computer system forming part of the module 24. The keyboard 26 allows instructions to be input to the computer system to effect the operation of motors 30, and the display 22 may be employed to provide a visual indication of both graphics and character information relating to the operations performed by the machine tool. Character or alphanumeric type data displayed on the screen 20 provides the machine operator with instructions and sequencing information and may also prompt the operator when certain sequences are completed.

Figures 2, 11:
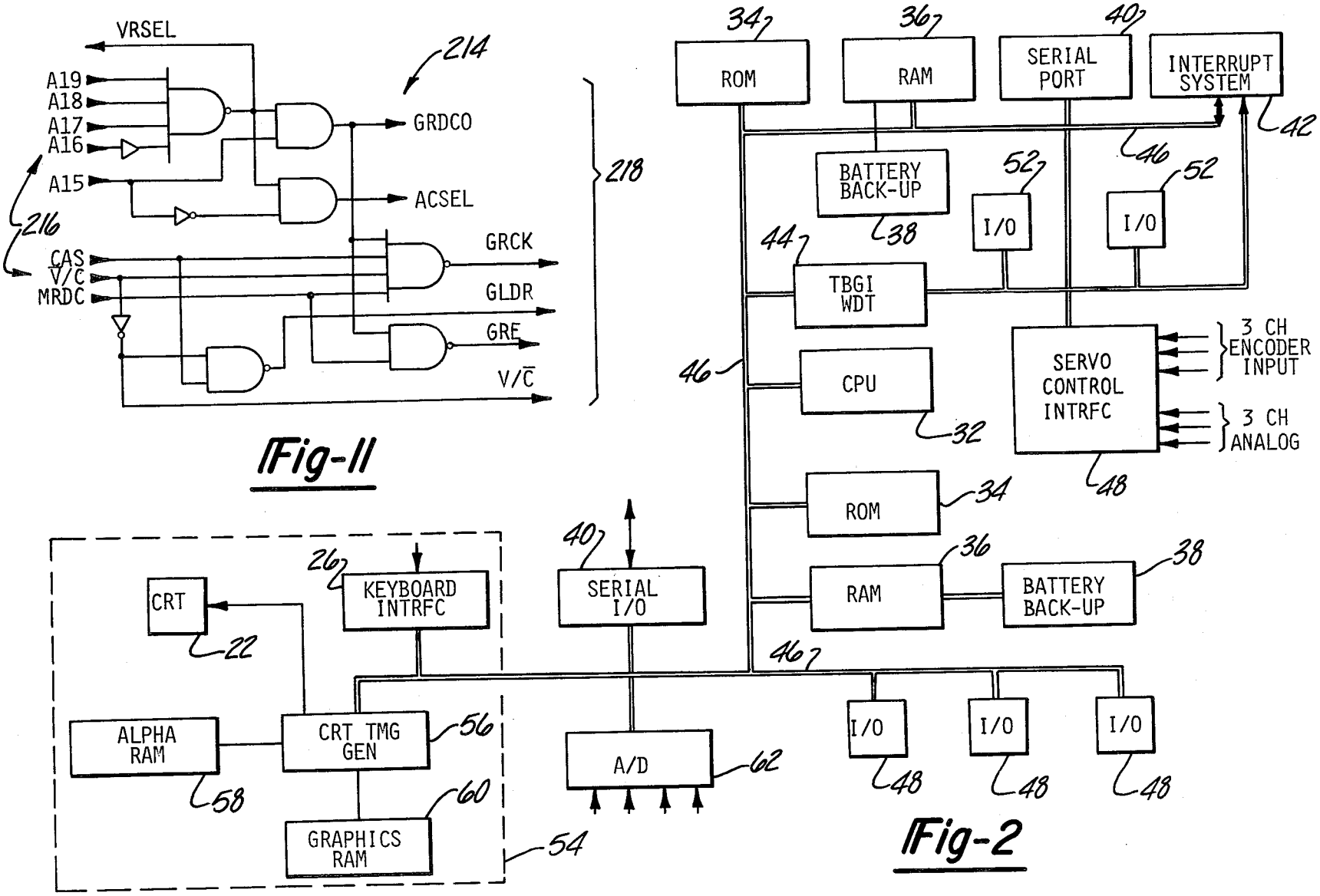
FIG. 2 is a simplified block diagram of the computerized control portion of the system of FIG. 1.
FIGS. 8, 9, 10 and 11, taken together, form a detailed schematic diagram of the display system shown in FIGS. 5 and 6.

Referring also now to FIG. 2, the computer system of the control module 24 includes a central processing unit 32 connected by a data bus 46 to one or more ROM's (read-only memories) 34, one or more RAM's (random access memories) 36, each of the RAM's being provided with a battery back-up 38 to prevent memory loss in case of power failure. One or more asynchronous serial ports 40 may also be provided along with a conventional interrupt 42 and a servo-control interface 48 which connects the computer system with motors 30. A time base generator and watchdog timer 44 are provided to prevent loss of axis control in the event of computer failure. Various peripheral input/output devices 48 and 52 may be provided, depending on the particular application of the system. In those applications requiring an analog input to the computer system, an A/D converter 62 is provided.

The display system 54 of the present invention includes a timing generator 56, alphanumeric RAM 58 and graphics RAM 60, in addition to display 22 and keyboard 26. The keyboard 26 may be configured in a conventional ASCII arrangement, or may be capable of inputting unique characters or symbols to the system.

Figure 4B:
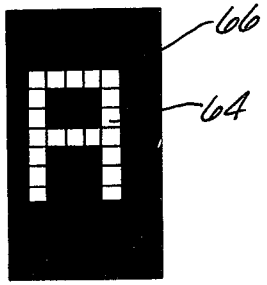
FIGS. 4A and 4B respectively represent character fields on the display screen and depicting the letter A wherein the state of the graphics and character display has been respectively reversed.
Figure 4A:
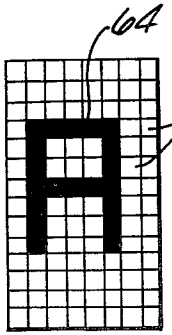

The display 22 may comprise a conventional CRT having 224 lines of display, each line including 512 pixels to form a 224×512 dot matrix. As will become apparent hereinafter, the computer system may be programmed to select any of a plurality of screen formats for the characters to be displayed. For example, the entire screen 20 may be filled with four lines of characters with 16 characters on each line. Alternatively, the screen may be filled with 16 lines of characters, of considerably smaller size, with 64 characters on each line. Assuming that 16 lines of 64 characters each have been selected, each character is displayed in a character field comprising 14 lines of eight rows of pixels as indicated in FIGS. 4A and 4B. The character 64, itself, is five pixels wide and seven pixels high and is positioned generally centrally within the character field. Although the character 64 is depicted in the drawings as comprising 5×7 pixels, any character size up to 8×14 pixels may be accomodated by the character generator 118. Moreover, although each character field is reserved for display of alphanumeric or other symbolic characters, the pixels 66, surrounding the character 64 within the character field, display graphical data, unless otherwise disabled as will be discussed below.

Figure 6:
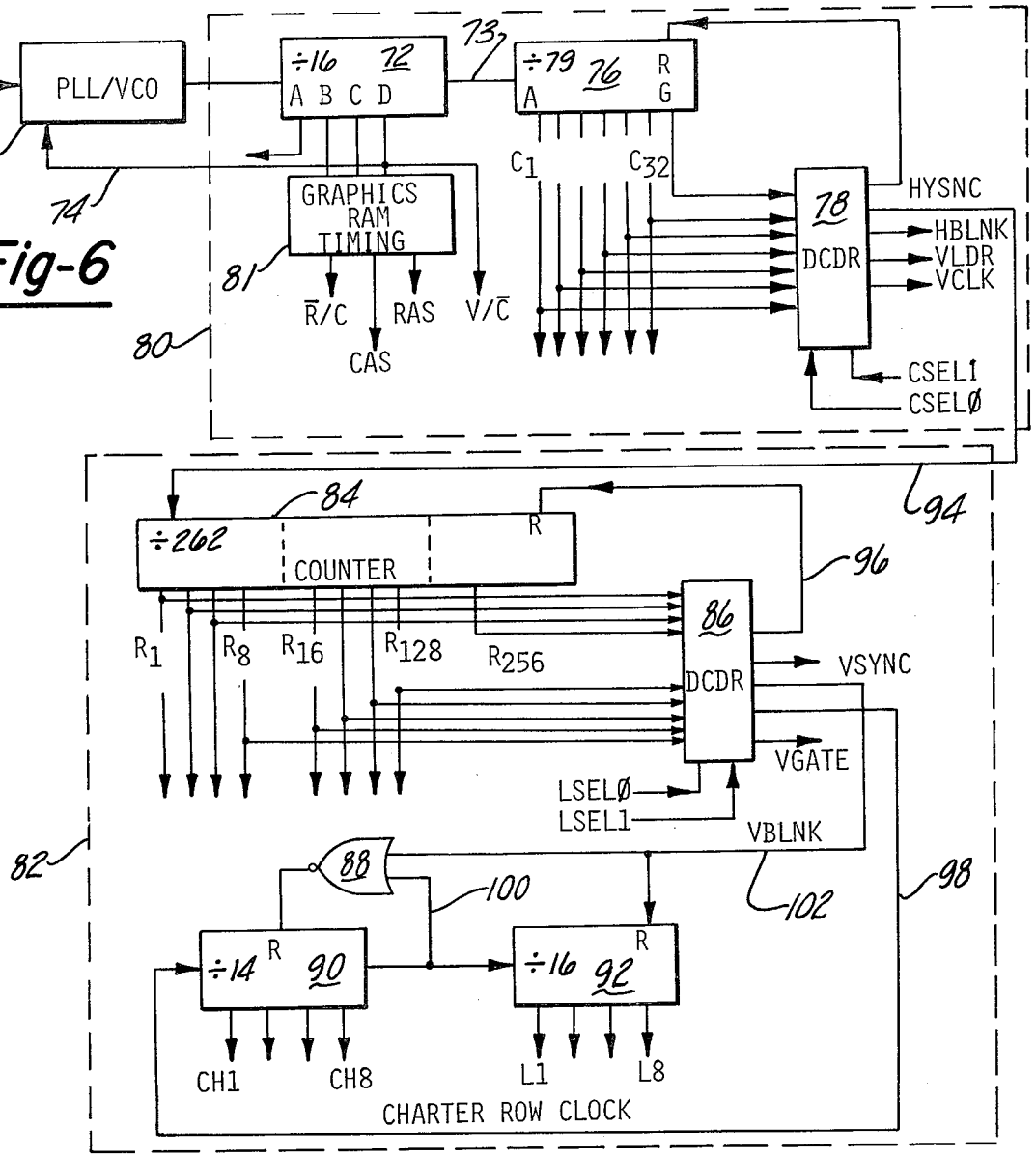
FIGS. 5 and 6, taken together, form a simplified block diagram of the display system of the present invention which forms a part of the computer control depicted in FIGS. 1 and 2.
Figures 5, 7:
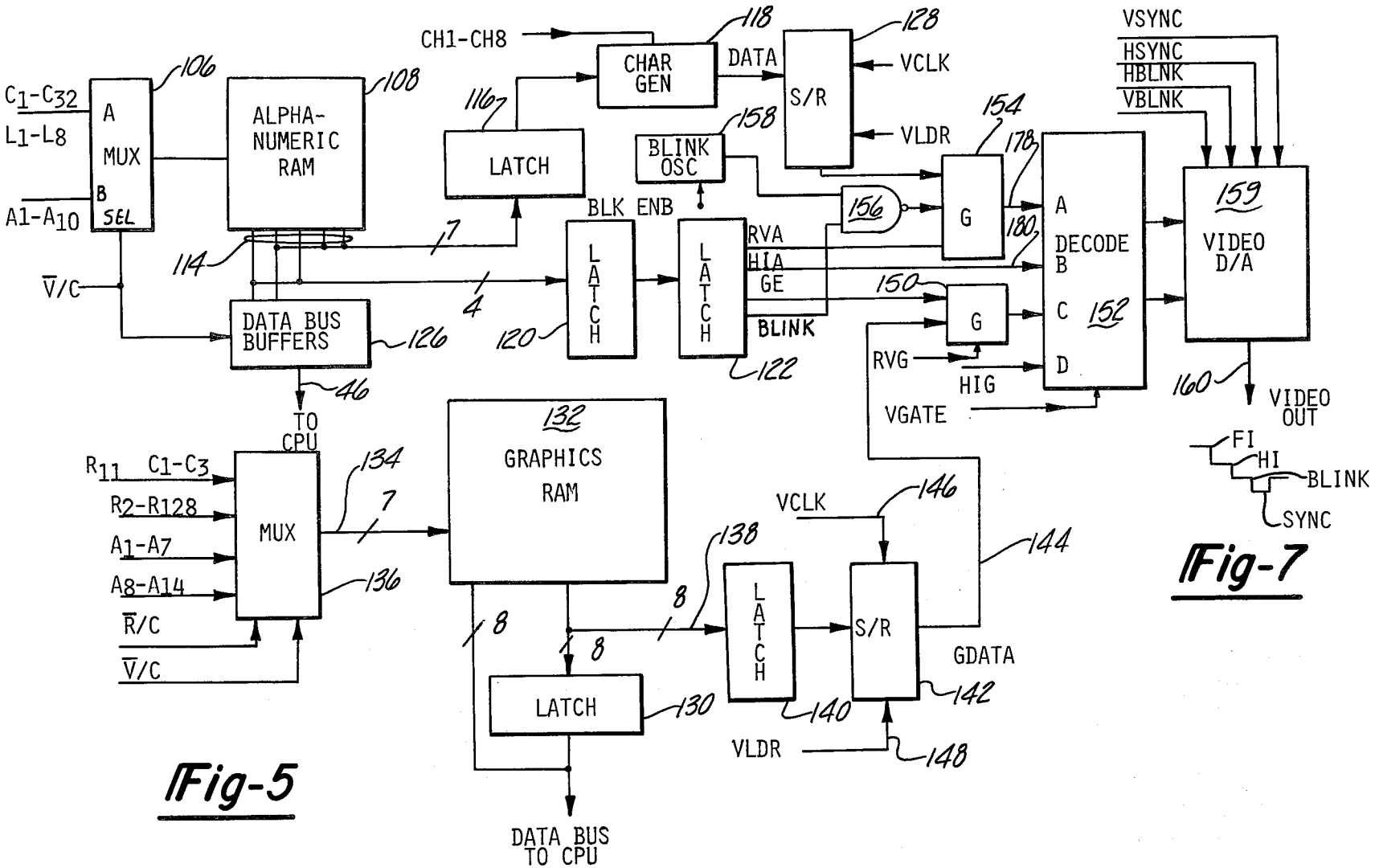
FIG. 7 is a diagrammatic view of the video output of the circuit of FIG. 5.

Turning attention now to FIGS. 5 and 6, timing signals for the system are derived from a clock source 68, which may comprise the same clock employed for establishing a time base for the central processing unit 32, shown in FIG. 2. The output of clock 68 may be regenerated and squared, if desired, and applied to a synchronizing circuit 70 which may comprise a phase locked loop in combination with a voltage controlled oscillator. The synchronizing circuit 70 synchronizes or slaves the entire display system to the clock 68, and thus to the central processing unit 32. In the preferred form, the video clock rate at which data is displayed on the screen 20 is 10 megahertz, consequently each pixel on the screen is energized for a duration of 100 nanoseconds. The output of the synchronizing circuit 70 is delivered to a divider 72 which divides the input by a factor of 16 and provides a plurality of time divided output signals on outputs A–D thereof. Output A of divider 72 provides the basic 10 megahertz video clock signal for clocking data onto the screen 20. Output D of divider 72 is routed by line 74 back to the synchronizing circuit 70 to complete the phase locked loop, thereby permitting the voltage controlled oscillator to be synchronized with the central processor 32. As will become apparent hereinafter, this synchronizing or phase locking of the timing circuit for the display to the central processor unit 32 allows for interleafing the processor 32 and the video circuitry of the display so as to share the display memories during alternate timing cycles. Output D of divider 72 also produces signal $V/\overline{C}$; when signal $V/\overline{C}$ is high, the video circuitry of the display is enabled, and when it is low, the computer (processor 32) is enabled. With a display rate of 10 megahertz, the frequency of the signal on output D of divider 72 is approximately 800 nanoseconds; this period represents eight horizontal pixels on one line of the screen 20, which corresponds to the width of one character field. This period also corresponds to eight horizontal pixels of graphics data. During the first 400 nanoseconds of the 800 nanosecond cycle, signal $V/\overline{C}$ is low and the processor 32 may communicate with the video circuitry, while in the second 400 nanosecond portion of the cycle, signal $V/\overline{C}$ is high and the video circuitry is enabled. In contrast, previous systems allow the processor 32 to access the video circuitry (e.g., display memories) at any time and thereby interrupting the video portion of the display cycle and causing interference or flickering on the screen.

The primary output of divider 72 is delivered via line 73 to the input of divider 76 which divides such input by a factor of 79. The first 64 counts output by divider 76 correspond to the 64 characters which can be displayed on each horizontal line, and are delivered to outputs A–F of divider 76 as signals $C_1$–$C_{32}$. The 65th through 79th counts are delivered on output G of divider 76 to decode logic 78 which outputs a series of signals in accordance with a combination of signals present on its input. Specifically, decode logic 78 outputs signals HSYNC, HBLNK, VLDR, and VCLK. Signal HSYNC provides the horizontal sync pulse employed by the display 22 to synchronize video timing. Signal HBLNK provides blanking of the video output when scanning terminates at the end of the line and returns to the beginning of the next line, thereby supressing retrace on the screen 20. Signal VLDR, video load register, controls later discussed shift registers which shift out either alphanumeric or graphic data from respectively associated display memories. Finally, signal VCLK, video clock, is employed to shift character data out of a later discussed character generator. As will be discussed later, decode logic 78 will include multiplex circuits responsive to the CPU (central processing unit) 32 which selectively allows the system to display either 16, 32 or 64 characters per line. The control signals derived from the CPU 32 for selecting the number of characters per line are designated as signal inputs CSEL0 and CSEL1 (character select 0 and character select 1). CSEL0 and CSEL1 provide two bits of data which establish the code determining number of characters per line selected.

The components discussed immediately above comprise the horizontal timing for the display, generally indicated within the broken line 80. Vertical timing for the display, generally indicated within the broken line 82, comprises divider 84, decode logic 86, NOR gate 88, and count dividers 90 and 92. The primary input to the vertical timing circuit 82 is derived from decode logic 78 on line 94 and comprises signal HSYNC. Divider 84 may comprise three counters configured to divide the HSYNC signal by a factor of 262. The first eight output stages of divider 84 on lines $R_1$–$R_{128}$ relate to the horizontal line of graphics displayed on the screen 20. The outputs of divider 84, comprising lines $R_1$–$R_{256}$ are applied to the inputs of decode logic 86. Decode logic 86 delivers a reset signal upon receipt of count 262 via line 96 to the divider 84, thereby resetting the latter. The first 224 counts output from divider 84 via lines $R_1$–$R_{256}$ determine the particular lines on the screen 20 which are enabled. The remaining counts output by divider 84 are decoded by decode logic 86 to produce signals VSYNC, VBLNK, CHAR ROW CLOCK, and VGATE. VSYNC consists of a vertical blanking pulse used to shut off the video signal to the display 22 to prevent display of retrace lines. CHAR ROW CLOCK is delivered via line 98 to divider 90 and signal VGATE is essentially identical to the previously discussed video clock signal, and will be described in detail later. Decode logic 86 is controlled by a pair of input signals LSEL0 and LSEL1 derived from the CPU 32. The two bits of data present on lines LSEL0 and LSEL1 form a code which determines one of three possible numbers of lines of characters to be displayed on the screen 20, i.e., 4, 8, or 16 lines.

Dividers 90 and 92 provide the timing logic for the rows of pixels defining each character to be displayed. Divider 90 may comprise a counter which provides a divide-by-14 operation corresponding to 14 lines of pixels in each character field. The CHAR ROW CLOCK signal on line 98 derived from decode logic 86 has one of three possible frequencies determined by the input code defined by signals LSEL0 and LSEL1 from the CPU 32. The maximum frequency of the CHAR ROW CLOCK signal on line 98 corresponds to the minimum vertical size of each character field, i.e., 16 lines of characters on the screen. The intermediate frequency of the CHAR ROW CLOCK signal corresponds to eight lines of characters while the lowest frequency corresponds to four lines of characters. Once divider 90 has been clocked 14 times, a reset signal is delivered via line 100 to one input of NOR gate 88, a second input to NOR gate 88 being formed by line 102 which carries signal VBLNK. The output of NOR gate 88 resets divider 90. The first four outputs of divider 90 form lines $CH_1$–$CH_8$, and the remaining output is delivered to a divide-by-16 divider 92, whose outputs are designated by $L_1$–$L_8$. Output lines $L_1$–$L_8$ correspond to the number of lines of characters to be displayed.

Figure 3:
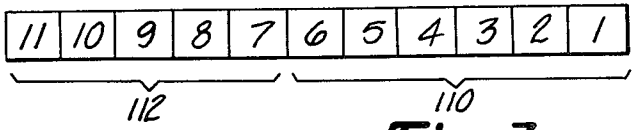
FIG. 3 is a diagrammatic representation of a multi-bit data word stored in the character memory.

Referring particularly now to FIGS. 3 and 5, a plurality of multi-bit data words 104 received from the CPU 32 on bus 46 are delivered on lines $A_1$–$A_{10}$ to a 2-to-1 multiplexer 106. Second and third sets of inputs to multiplexer 106 are defined by lines $C_1$–$C_{32}$ derived from divider 76 and lines $L_1$–$L_8$ derived divider 92. Words 104 are clocked into storage locations in an alphanumeric, random access memory (RAM) 108 in accordance with address locations defined by lines $C_1$–$C_{32}$ and $L_1$–$L_8$. The data output lines are coupled via buffers 126 to the CPU 32. Data output from buffers 126 to the CPU 32 on data bus 46 is determined by signal $\overline{V}/C$ output from multiplexer 106.

The multi-bit data word 104 includes first and second subgroups of data bits 110 and 112, respectively. Subgroup 110 comprises the six least significant bits of word 104 and correspond to any of a plurality of possible characters or symbols to be displayed on the screen 20. In the preferred form, subgroup 110 corresponds to one of 64 possible characters in a basic ASCII character set, i.e., 0–9, A–Z, etc. Subgroup 112 corresponds to a possible modification of the data to be displayed on screen 20. The seventh bit represents reverse video and determines whether colors of the character 64 and the background pixels 66 surrounding the character are reversed; for example, the presence of one type of data in the seventh bit of word 104 may result in the character 64 being black and the background pixels 66 being white as shown in FIG. 4A, while the presence of another type of data in the seventh bit will result in the display shown in FIG. 4B wherein the character 64 is white and the background pixels 66 are black. This technique of video reverse is particularly effective in calling the operator's attention to an error; for example, characters representing an error message may be displayed in white and the standard characters may remain black.

The eighth bit of word 104 may be employed to produce periodic blinking of the character in the character field. With the proper data loaded into bit 8, the pixels defining the character 64 are periodically enabled so as to cause the character 64 to appear to blink. This feature is particularly advantageous in attracting the operator's attention. The blinking feature may be used in combination with the reverse video feature controlled by bit 7 to simulate or signify an error condition or an abort situation.

Bit 9 of word 104 allows a second set of characters to be defined by the second subgroup of bits 110, i.e., with bit 8 in one state, subgroup 110 defines one of a plurality of characters in a first group thereof, such as the ASCII set, but the opposite state of bit 8 results in the subgroup 110 defining one of a plurality of characters in a second group thereof, such as a series of symbols. This feature greatly increases the flexibility of the present display system since the manufacturer can provide the user with a first basic set of characters, such as the ASCII set, and the user may then, himself, program the system to display an alternate set of symbols or characters.

The tenth bit of data word 104 determines whether or not the character 64 is displayed at full or half intensity. This feature is particularly useful in text processing to aid the user in inputting data to the system; for example, the operator may initially select certain characters to be input to the system, and such initially selected characters will appear at half intensity on the screen 20. Upon actuating an enter key on the keyboard 26, the data corresponding to the characters appearing at half intensity on the screen 20 will be actually input to the data system and will then appear at full intensity on the screen 20.

The eleventh bit of word 104 is operative to disable the display of the graphics pixels 66 in the character field surrounding the character 64. By disabling the graphics pixels 66 in each character field, the character 64 appears on a graphics-free background and is therefore quite easy to read. This feature is particularly useful in displaying titles or the like. It is to be noted, however, that the graphics data displayed in the character field by graphics pixels 66 is not lost from memory, and may be restored at any time. Additional bits, such as bit 12 of word 104, may be provided to later expand the system to accommodate further display features.

The multi-bit data words 104 are clocked out of RAM 108 onto data output lines 114; the first subgroup of data bits 110 are delivered to latch 116 for temporary storage and thence to character generator 118. The second subgroup of bits 112 is delivered to latches 120 and 122 and are respectively output on individual lines from latch 122 as signals RVA (reverse video alpha), GE (graphics enable), HIA (half intensity alpha), and BLNK (blink). The three most significant bits of word 104 are also delivered on certain of output lines 114 to data bus buffers 126, thence onto a data bus 46 to the CPU 32. The operation of multiplexer 106 and data bus buffers 126 is controlled by signal $\overline{V}/C$, which is the inverse of the signal $V/\overline{C}$.

The character generator 118 may comprise a suitable memory such as a ROM, which may be programmable if desired. In the preferred form, an erasable programmable read-only memory may be employed as the character generator 118 so as to allow the user to select the particular characters he wishes to display. The memory of the character generator 118 is addressed by an 11 bit word, seven bits of which are derived from data output lines 114, the remaining, least significant bits of the address being derived from the vertical timing circuit 82 as signals $CH_1$–$CH_8$. An eight bit word corresponding to the generated character is delivered from the character generator 118 to a shift register 128 in accordance with signal VLDR which forms a load input to shift register 128. Data is shifted out of shift register 128 in accordance with signal VCLK which forms a clock input of shift register 128 and is derived from the horizontal timing circuit 80, shown in FIG. 6.

In order to simplify the display circuit of the present invention, data is loaded into and out of RAM 108 at the same rate regardless of the number of characters being displayed on each line. This allows the timing of the CPU 32 to be interleafed with the display circuit as previously discussed. More specifically, signal VLDR is generated in accordance with the number of characters per line. Assuming that the operating frequencies previously mentioned are employed, signal VLDR is generated once every 800 nanoseconds if 64 characters per line is selected. If, however, 32 characters per line is selected, VLDR is produced only every second character, i.e., every 1.6 microseconds. Finally, if 16 characters per line is selected, VLDR is generated every 3.2 microseconds. It may therefore be appreciated that data is output from RAM 108 at a constant rate; however, only every character, every other character, or every fourth character is selected for processing, depending upon the number of characters per line which have been selected.

Graphics data is delivered from the CPU 32 on data bus 46 through latch 130 into a graphics memory, which preferably comprises a RAM (random access memory) 132. RAM 132 stores the graphics data in eight bit words and is addressed via line 134 from a plurality of inputs to a multiplexer 136. Address inputs to multiplexer 136 comprise lines $A_1$–$A_{14}$ derived from CPU 32, $R_1$ and $C_1$–$C_{32}$. Lines $A_1$–$A_{14}$ permit the CPU 32 to address RAM 132, while lines $A_1$–$A_{10}$ permit the CPU 32 to address RAM 108. The multiplexer 136 is controlled by signal inputs $\overline{R}/C$ and $\overline{V}/C$ derived from the horizontal timing circuit 80 in FIG. 6. Signal $\overline{R}/C$ determines which group of addresses are being supplied to RAM 132. When signal $\overline{R}/C$ is low, address lines $R_1$ and $C_1$–$C_{32}$ are applied, and when such signal is high, address lines $R_1$–$R_{128}$ are applied. The state of signal $\overline{V}/C$ determines whether multiplexer 136 is responsive to video or CPU addresses.

Graphics data in eight bit words are read from RAM 132 and delivered via line 138 to latch 140 for temporary storage, and thence to shift register 142. The graphics data is shifted out onto line 144 as signals GDATA, in accordance with clock signals received on line 146. The graphics data displayed on screen 20 remains constant in size, consequently the rate at which graphics data is clocked out on line 144 remains constant even though other elements of the displayed image are altered. Signals VLDR on line 148 load shift register 142.

As previously indicated, graphics data output from RAM 132 may be delivered to latch 130 for transfer to data bus 46; latch 130 temporarily holds the output data until clocked onto the data bus 46, thereby freeing the RAM 132 to output graphics data for video use on line 138. Accordingly, the operation of the CPU 32 is interleafed with the operation of the display so as to prevent flicker or other interruptions in the displayed image when the CPU 32 reads information into, or writes information from, RAM 132.

Graphics data on line 144 is delivered to one input of a gating circuit 150, a second input to gating circuit 150 comprising the gate enable (GE) line derived from latch 122. A third input to gating circuit 150 is formed by signal RVG which is received from the CPU 32. The output of gating circuit 150 is delivered to one input of a decoding circuit 152. Another input to decoding circuit 152 is formed by signal HIG also derived from CPU 32. A third input to decoding circuit 152 is formed by signal HIA which comprises the tenth bit of data word 104. The seventh and eighth bits of word 104 output from latch 122 as signals RVA and BLNK, respectively, are delivered to two inputs of gating circuit 154, a second input to circuit 154 being formed by the output of a NAND gate 156. Dual inputs of gate 156 are respectively coupled to a BLNK oscillator 158 and the data output of latch 122.

Decoder circuit 152 delivers output signals to a video D-to-A converter 159 determined by the coded combination of data bits on inputs A–D thereof, and in accordance with clock signals VGATE. It is to be noted that the decoding circuit 152 in combination with gates 150 and 154 do not merely algebraically sum the inputs thereto, but rather produce output signals in accordance with a predefined priority scheme. The bit loaded into the A input of decoding circuit 152 determines whether the character 64 will blink, as well as whether or not the display thereof will be reversed with the graphics data. The character data, in serial form, is also delivered to the A input of circuit 152. The state of the bit present at input B of circuit 152 determines whether or not the character will be displayed at full or half intensity. The state of signals received at input C determines whether or not the graphics data in the character field will be enabled and also whether the display of such graphics data will be reversed with that of the character. As previously mentioned, graphics data is delivered via line 144 and is input to the decoding circuit 152 at input C thereof. The data bit delivered to input B of decoder circuit 152 determines whether the graphics data will be displayed at full or half intensity. Input D corresponds to the highest priority input to the decoder circuit 152 while input A corresponds to the lowest priority.

Digitized data delivered from decoding circuit 152 to the D-to-A converter 159 are converted to analog signals and combined with vertical and horizontal syncing and blanking signals to produce a video output on line 160. The level of output signals present on line 160 may be at one of four discrete levels, as shown in FIG. 7. The vertical sync signal comprises the lowest level, with the BLNK, half intensity and full intensity signals representing respectively higher levels. From the foregoing, it may be appreciated that the brightest signal processed by the display circuit has the highest priority of display and signals of progressively lower intensity have corresponding lower priorities of display. Thus, in a display image where the character or alphanumeric data overlays graphics data and one of these data is at half intensity while the other is at full intensity, the pixel corresponding to the full intensity will be displayed at full intensity. This eliminates more than two levels of intensities, as would result with the use of an algebraic type summing circuit. Consequently, the image displayed on screen 20 by the present display system is particularly uniform.

It should be noted that signal VGATE applied to decoder circuit 152 is operative to clock the output of the D-to-A converter 159 between half or full intensity and the blanking level. The effect of this control is that each pixel is turned on and off with the same rise and fall time to produce very uniform displays of horizontal lines of pixels; consequently, the horizontal lines of pixels appear to have the same intensity as the vertical rows of pixels.

Figure 8:
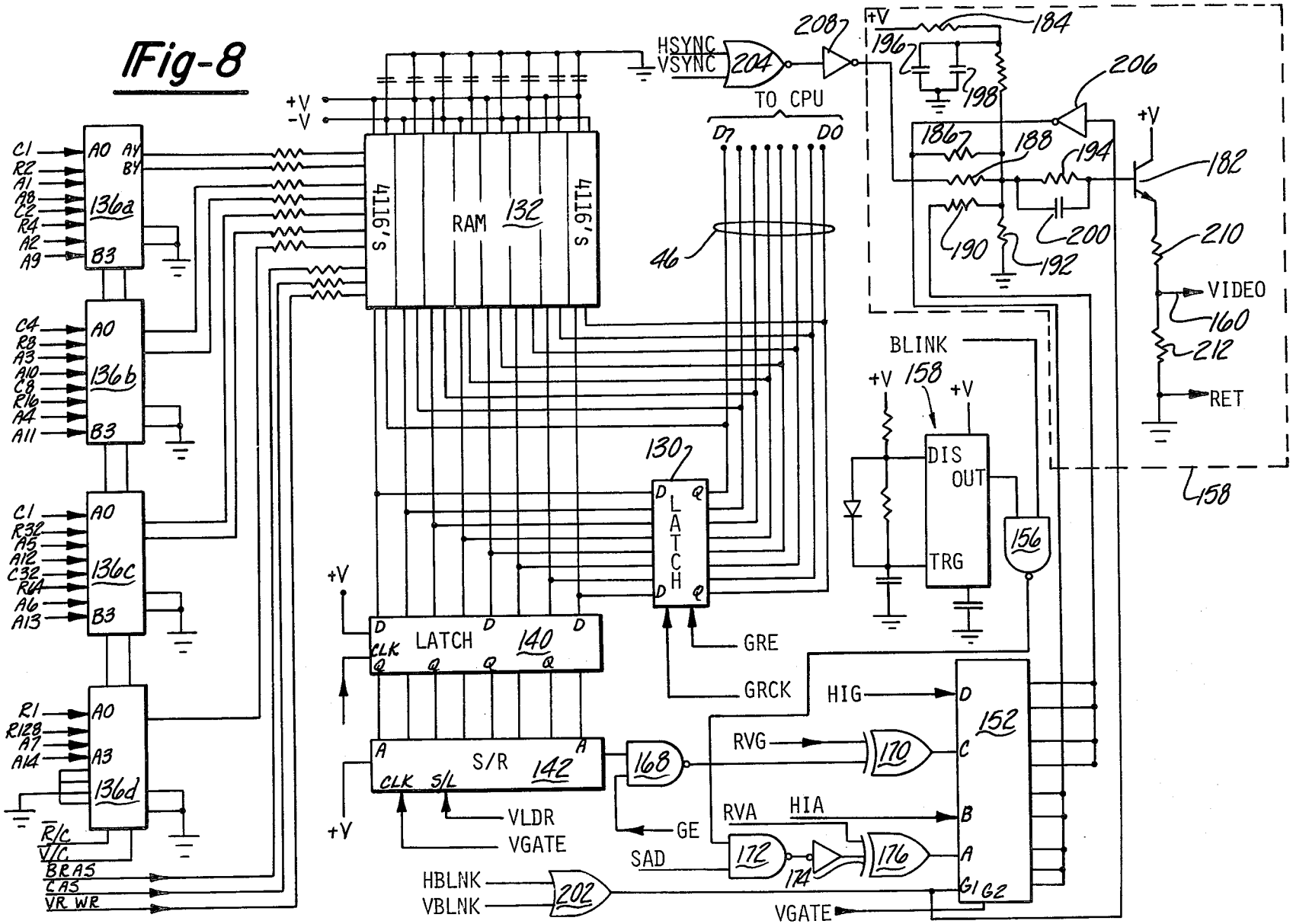

Referring now to FIG. 8, multiplexer 136 is of a four-to-one type and may comprise four interconnected multiplex units 136A–136D, such as '153's well known in the art. Multiplex units 136A–136D are connected by corresponding resistors to the address inputs of RAM 132. RAM 132 may comprise eight 16K×1 bit type memories interconnected with each other to form a 16,384×8 bit memory, controlled by signals present on line 164 derived from the CPU 32.

Gating circuit 150, shown in FIG. 5, comprises AND gate 168 and an exclusive OR gate 170. One input of exclusive OR gate 170 is coupled with the CPU 32 for receiving signal RVG, while the other input thereof forms the output of NAND gate 168. One input of NAND gate 168 is coupled with the output of shift register 142, while the other input thereof receives the graphics enable signal (GE), which corresponds to the 11th bit of data word 104.

Gating circuit 154 comprises NAND gate 172, inverter 174, and exclusive OR gate 176. One input of NAND gate 172 is formed by the output of NAND gate 156, the other input thereto being derived from shift register 128 for receiving character data in serial form. The output of NAND gate 172 forms one input of exclusive OR gate 176, the other input to gate 176 being derived from latch 122 as signal RVA.

The blink oscillator 158 is standard in construction and may comprise a 555 type timer. The decoding circuit 152 may comprise a standard 4-to-16 decoder, having the outputs thereof connected in two groups via lines 178 and 180 to two inputs of the D-to-A converter 158. Converter 158 includes a transistor 182 having the base thereof connected to an RC network comprising resistors 184–194 and capacitors 196–200. Horizontal and vertical sync, as well as horizontal and vertical blanking signals, are gated through OR gates 202 and 204, whose outputs are inverted by inverters 206 and 208, respectively; the outputs of inverters 206 and 208 are coupled to the RC network mentioned immediately above. The collector of transistor 182 is coupled with a suitable source of voltage, while the emitter thereof is connected via resistors 208 and 210 to ground. The video output on line 160 is defined by a connection between resistor 208 and 210.

Figure 9:
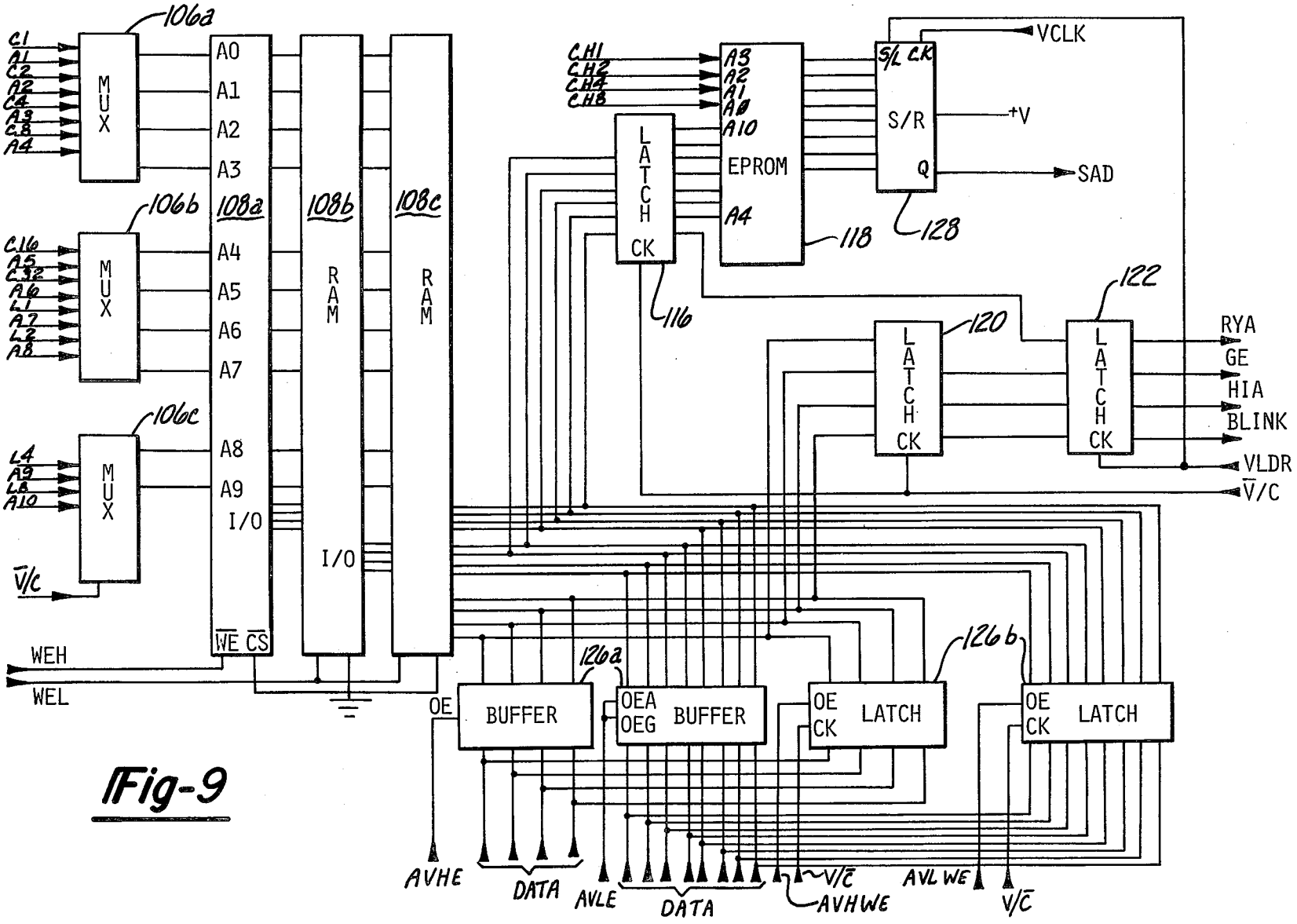

Referring now to FIG. 9, multiplexer 106 may comprise three interconnected multiplexing chips 106A, 106B and 106C, such as type '157's. The outputs of multiplex chips 106A–106C form a nine bit address to RAM 108. RAM 108 may consist of three 2114 units 108A, 108B and 108C interconnected to form a 12×1024 bit array. The data bus buffers 126 comprise a pair of '244 chips 126A, and a pair of '374 chips 126B which function as latches. Note that chips 126B are clocked by signal $V/\overline{C}$, while latches 116, 120 and 122 are clocked by signal $V/\overline{C}$.

Although not previously discussed, the display will include a suitable address decoding and timing circuit generally indicated by the numeral 214. Circuit 214 comprises a series of NAND gates and inverters and receives address and timing signals on inputs 216, while decoded signals are delivered on outputs 218.

Figure 10:
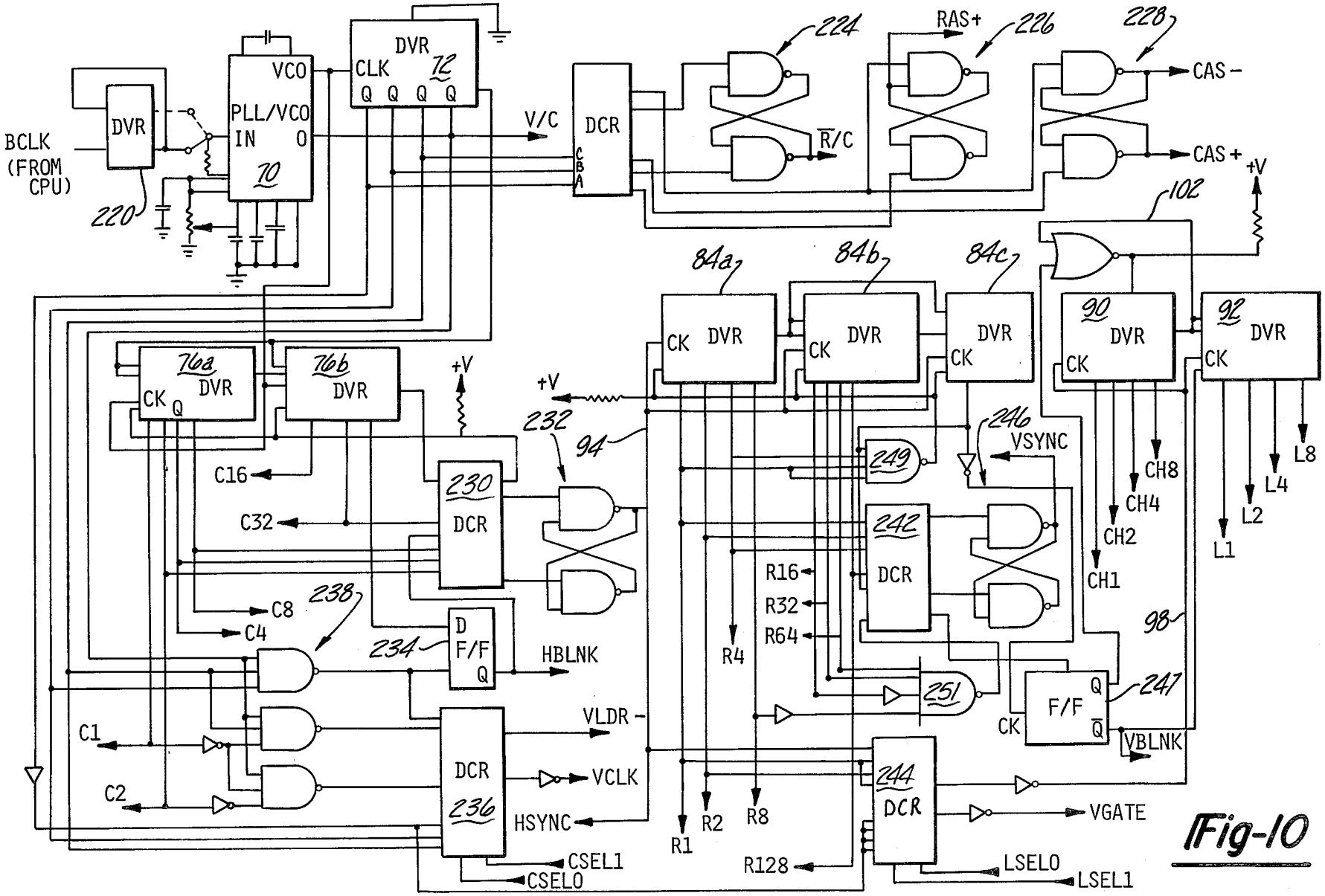

Referring now to FIG. 10, wherein the details of the timing circuit are shown, the clock signals received from the CPU system clock 68 are divided in half by a divider 220 and then delivered to the input of the synchronizing circuit 70, which comprises a standard phase locked loop chip such as an NE 564. The divide-by-79 divider may comprise a pair of '163 type chips 76A and 76B suitably connected together. The graphics RAM timing circuit 81 includes a 3-to-8 decoder whose outputs are coupled with three flip-flops 224–228 which each comprise a pair of cross coupled NAND gates. Divider 84 may comprise three interconnected '163 counter chips, 84A, 84B and 84C. Dividers 90 and 92 may also comprise '163 type counters.

The horizontal decoding logic 78 comprises a 3-to-8 decoder 230, flip-flop 234 and a 4-to-1 decoder 236, in addition to a pair of cross coupled NAND gates 232 and NAND gate arrangement 238. The outputs of decoder 230 are delivered through gates 232 to line 94 and thence to divider 84. Flip-flop 234 has the inputs thereof coupled with the outputs of dividers 72 and 76 and provides the horizontal blanking signal on line 240. Gate arrangement 238 is employed to gate output signals from dividers 72 and 76 to flip-flop 234, as well as to the inputs of decoder 236. The outputs of decoder 236 provide signals VCLK and VLDR.

The vertical decoding logic 86 includes a 3-to-8 decoder 242, 4-to-1 decoder 244, flip-flops 246 and 247 and NAND gates 249 and 251. The inputs of decoder 242 are coupled to the output of divider 84A, and two outputs thereof are delivered through flip-flop 246 to provide the vertical sync pulse. The inputs of decoder 244 are coupled to the outputs of divider 84A and divider 72, while the output thereof provides signal VGATE.

From the foregoing, it is apparent that the display system described above not only provides for the reliable accomplishment of the objects of the invention, but does so in a particularly effective and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A device for producing electrical signals used to simultaneously display symbolic and graphical data, said device being adapted to be employed with a computer data system including a data input, a data processor and a data output display having lines and columns of electrically responsive pixels for displaying said data, comprising:

timing means for producing a plurality of timing signals;

first memory means having addressable inputs coupled with said processor for storing a plurality of first multi-bit data words therein, each of said first data words having a first subgroup of data bits corresponding to a selected symbol and a second subgroup of data bits corresponding to a modification of the data to be displayed;

second memory means having addressable inputs coupled with said processor for storing a plurality of second multi-bit data words therein each corresponding to a portion of said graphical data;

symbol generator means connected to said first memory for generating signals representing said symbols defined by said first group of data bits;

circuit means for combining video signal, said circuit means being connected to receive the signals from the symbol generator means, being connected to receive graphical data from the second memory means, and being operable to selectively combine the symbol generator means signals with the graphical data to produce an output signal in accordance with a preselected order of priority which is determined by said second subgroup of data bits received from the first storage means; and means for generating output video signals to drive said display in response to the output signal of the circuit means.

2. The device of claim 1, wherein said timing means includes:

time base means for supplying clock signals to said processor and to said first memory means, second memory means and said circuit means, and means coupled with said time base means for allowing alternate access to said first and second memory means by said processor and said circuit means, respectively.

3. The device of claim 2, wherein said means for allowing alternate access comprises means for dividing the frequency of said clock signals.

4. The device of claim 3, wherein said dividing means includes first and second frequency dividers respectively associated with horizontal lines and vertical columns of said pixels, and said timing means further includes first and second decoders controlled by said processor for outputting said timing signals in accordance with signals received from said processor.

5. The device of claim 1, including multiplexing means coupling said processor with the inputs of said first and second memory means.

6. The device of claim 1, wherein said circuit means includes means coupled with said first memory means and responsive to at least one of said data bits in said second subgroup thereof for inhibiting delivery of video signals corresponding to said symbolic data from said circuit means to said display.

7. The device of claim 1, wherein said first memory means includes a first data output coupled with said symbol generator means for delivering said first subgroup of data bits thereto, and a second data output coupled with said circuit means for delivering said second subgroup of data bits to said circuit means.

8. The device of claim 7, wherein said circuit means includes:

first gate means having inputs respectively coupled with said second data output and said symbol generator means and having an output for gating said signals representing said symbols and at least certain of said bits of said second group of data bits, decoder means having a plurality of inputs and outputs, one of said last-named inputs being coupled with the output of said first gate means, and being operative to deliver data signals on said outputs thereof in accordance with a preselected combination of signals present on the inputs thereof.

9. The device of claim 8, wherein said circuit means further includes second gate means having a pair of inputs respectively coupled with said first and second memory means, said second gate means having a gate output coupled with one of said inputs of said decoder means.

10. The device of claim 8, wherein said means for generating output video signals comprises a digital-to-analog converter coupled with said outputs of said decoder means.

11. A method of simultaneously displaying superimposed symbolic and graphical data on a display screen having aligned rows and columns of display pixels, comprising the steps of:

(A) generating a first multi-bit data word having a first subgroup of data bits corresponding to a symbol to be displayed in a field of $N \times M$ pixels on said screen, and a second subgroup of data bits corresponding to a possible modification of the symbolic and graphical data to be displayed on said screen;

(B) generating a second multi-bit data word corresponding to at least a portion of said graphical data to be displayed;

(C) producing data signals using the first and second data words generated in steps (A) and (B);

(D) modifying at least certain of the data signals produced in step (C) in accordance with a preselected order of priority which is determined by certain of the data in the second subgroup of data bits generated in step (A); and (E) producing video signals for use in driving said display screen using the data signals modified in step (D).

12. The method of claim 11, including the steps of:

(F) storing said first data word in a first memory;

(G) storing said second data word in a second memory.

13. The method of claim 12, including the step of:

(H) generating data signals representing said symbol using said first subgroup of data bits of said first data word stored in said first memory.

14. The method of claim 13, wherein step (D) is performed by gating data signals developed in step (H) with data signals corresponding to the data in said second subgroup of data bits.

15. The method of claim 14, wherein step (E) is performed by selecting the data signals modified in step (D) in a preselected order of priority.

16. The method of claim 11, wherein step (E) is performed by selecting the data signals produced in step (C) and the data signals modified in step (D) in a predetermined order of priority.

17. The method of claim 11, wherein step (C) includes the substep of producing timing signals corresponding in time to the frequency at which said data signals are produced, and there is further included the step of (F) altering the number of fields on each row of said pixels by modifying the frequency of said timing signals.

* * * * *